US012736293B2

(12) United States Patent
Kamata et al.

(10) Patent No.: US 12,736,293 B2
(45) Date of Patent: Sep. 15, 2026

(54) HEAT EXCHANGE STRUCTURE COMPRISING INSERTABLE ALTERNATING FIN STRUCTURE

(71) Applicant: IHI CORPORATION, Tokyo (JP)

(72) Inventors: Hiroyuki Kamata, Tokyo (JP); Shigeki Sakakura, Tokyo (JP); Nobuyuki Honma, Tokyo (JP); Akihisa Yano, Tokyo (JP); Taiga Yamamoto, Tokyo (JP); Yusuke Takeuchi, Tokyo (JP); Takuya Yoshinoya, Tokyo (JP); Takuya Hashimoto, Tokyo (JP); Daisuke Tsunoda, Tokyo (JP)

(73) Assignee: IHI CORPORATION, Tokyo (JP)

( * ) Notice: Subject to any disclaimer, the term of this patent is extended or adjusted under 35 U.S.C. 154(b) by 352 days.

(21) Appl. No.: 18/087,123

(22) Filed: Dec. 22, 2022

(65) Prior Publication Data

US 2023/0130165 A1 Apr. 27, 2023

Related U.S. Application Data

(63) Continuation of application No. PCT/JP2020/030883, filed on Aug. 14, 2020.

(51) Int. Cl.
*F28F 3/08* (2006.01)

(52) U.S. Cl.
CPC ..... *F28F 3/086* (2013.01); *F28F 2215/00* (2013.01)

(58) Field of Classification Search
CPC ..... F28F 13/12; F28F 1/40; F28F 2215/00; F28F 3/086
See application file for complete search history.

(56) References Cited

U.S. PATENT DOCUMENTS 2,091,274 A 8/1937 Eggleston
3,769,959 A * 11/1973 Parker ..... F28F 13/12 165/185
5,036,906 A * 8/1991 Rylewski ..... F24F 12/006 165/909

(Continued)

FOREIGN PATENT DOCUMENTS

CA 3 015 192 A1 9/2017
CN 104168995 A 11/2014

(Continued)

OTHER PUBLICATIONS

Japan Patent Office, "Notice of Reasons for Refusal", issued in Japanese Patent Application No. 2019-032502 and mailed on Dec. 6, 2022, 5 pages (3 pages of English translation of Notice of Reasons for Refusal and 2 pages of original Notice of Reasons for Refusal).

(Continued)

*Primary Examiner* — Travis Ruby

(57) ABSTRACT

A heat exchange structure includes: two flow channels stacked in a stacking direction (Y direction) and thermally coupled to each other; and a fin structure detachably installed in at least one flow channel of the two flow channels. The fin structure includes fins arranged in a longitudinal direction (Z direction) of the at least one flow channel in which the fin structure is installed, the fins configured to form openings alternately arranged along the at least one flow channel on one side and the other side of the at least one flow channel in the stacking direction.

22 Claims, 16 Drawing Sheets

(56) References Cited

U.S. PATENT DOCUMENTS

| | | | | |
|---|---|---|---|---|
| 5,040,596 | A * | 8/1991 | Terasaki | F28F 3/02 165/185 |
| 5,125,451 | A * | 6/1992 | Matthews | F28F 3/12 257/E23.098 |
| 5,738,493 | A * | 4/1998 | Lee | F28F 13/12 415/115 |
| 5,797,726 | A * | 8/1998 | Lee | F01D 5/187 416/97 R |
| 6,273,183 | B1 * | 8/2001 | So | F28D 1/0333 165/152 |
| 9,446,374 | B2 * | 9/2016 | Lingvall | F28F 3/083 |
| 11,175,102 | B1 * | 11/2021 | Harrington | F28F 9/165 |
| 2006/0162919 | A1 * | 7/2006 | Terada | F28F 1/045 165/110 |
| 2007/0163768 | A1 * | 7/2007 | Shinhama | F28F 3/025 165/906 |
| 2008/0105413 | A1 * | 5/2008 | Peng | F28F 13/185 165/104.33 |
| 2011/0108253 | A1 | 5/2011 | Cool | |
| 2014/0110085 | A1 | 4/2014 | Deckers et al. | |
| 2015/0017080 | A1 | 1/2015 | Lingvall | |
| 2015/0308756 | A1 | 10/2015 | Lee | |
| 2017/0211893 | A1 | 7/2017 | Noishiki | |
| 2017/0223869 | A1 * | 8/2017 | Shibasaki | H05K 7/20263 |
| 2018/0318786 | A1 | 11/2018 | Yano et al. | |
| 2019/0310031 | A1 | 10/2019 | Disori et al. | |

FOREIGN PATENT DOCUMENTS

| | | | |
|---|---|---|---|
| CN | 106996708 | A | 8/2017 |
| CN | 108698016 | A | 10/2018 |
| CN | 208911740 | U | 5/2019 |
| EP | 3 603 797 | A1 | 2/2020 |
| JP | S49-087753 | U1 | 7/1974 |
| JP | S51-041353 | U1 | 3/1976 |
| JP | S52-005352 | U1 | 1/1977 |
| JP | S53-015656 | A | 2/1978 |
| JP | S53-103961 | U1 | 8/1978 |
| JP | 2004-233013 | A | 8/2004 |
| JP | 2007-178010 | A | 7/2007 |
| JP | 2008-157506 | A | 7/2008 |
| JP | 2011-526996 | A | 10/2011 |
| JP | 2015-535585 | A | 12/2015 |
| JP | 2017-140591 | A | 8/2017 |

OTHER PUBLICATIONS

European Patent Office, "Extended European Search Report", issued in European Patent Application No. 20949545.6, which is a counterpart to U.S. Appl. No. 18/087,123, on Mar. 11, 2024, 6 pages.

China National Intellectual Property Administration, "Official Action", issued in Chinese Patent Application No. 202080102346.6, which is a counterpart to U.S. Appl. No. 18/087,123, on Mar. 31, 2025, 8 pages.

* cited by examiner

HEAT EXCHANGE STRUCTURE COMPRISING INSERTABLE ALTERNATING FIN STRUCTURE

CROSS REFERENCE TO RELATED APPLICATIONS

This application is a continuation application of International Application No. PCT/JP2020/030883, now WO 2022/034683 A1, filed on Aug. 14, 2020, the entire contents of which are incorporated by reference herein.

BACKGROUND

1. Technical Field

The present disclosure relates to a heat exchange structure that performs a heat exchange between two fluids.

2. Description of the Related Art

The heat-exchange catalytic reactor includes a heat-exchange structure that performs a heat exchange between two fluids. The heat exchange structure includes a heat medium flow channel and a reaction flow channel, which are adjacent to each other. A heat medium flows in the heat medium flow channel. A reaction fluid, which contains a reactive raw material, flows in the reaction flow channel. The heat medium flow channel and the reaction flow channel are thermally coupled to each other through a partition. Therefore, the heat exchange occurs between the heat medium and the reaction fluid between which there is a temperature difference, and the reaction of the reactive raw material is promoted.

A fin structure may be installed in at least one of the heat medium flow channel and the reaction flow channel to improve the overall heat transfer coefficient between the heat medium and the reaction fluid. The fin structure is called corrugated fins or waving fins. It is formed, for example, by bending a metal plate. The fin structure has a number of fins (side surfaces) that stretched or curved in the longitudinal direction of the channel in which the fin structure is installed. In this regard, JP 2017-140591 A discloses a heat transfer promoter as the fin structure. When the aforementioned fin structure is installed in the reaction flow channel, the catalyst may be supported on the fin structure.

SUMMARY

Conventional fin structures deflect or disperse fluid along a surface on which the fins are placed. Therefore, when such a fin structure is in in the heat exchange structure described above, the fluid generally flows along the partition. On the other hand, heat to be exchanged between the heat medium and the reaction fluid is transferred through this partition. The heat flux is proportional to the temperature difference (temperature gradient). Therefore, the heat transfer between the fluids is larger closer to the partition where the temperature boundary layer is generated, and is smaller farther from the partition. Accordingly, the farther the fluid is from the partition, the less likely it is to be heated (or cooled). This situation hinders the improvement of the heat transfer rate. In order to sufficiently heat (cool) the fluid everywhere, it can be dealt with by lengthening the flow path of the fluid. In this case, however, the equipment becomes larger, and the manufacturing cost increases.

The present disclosure has been made to provide a heat exchange structure capable of improving the overall heat transfer coefficient between two fluids in a space with a limited length.

An aspect of the present disclosure is a heat exchange structure including: two flow channels stacked in a stacking direction and thermally coupled to each other; and a fin structure detachably installed in at least one flow channel of the two flow channels, wherein the fin structure includes fins arranged in a longitudinal direction of the at least one flow channel in which the fin structure is installed, the fins configured to form openings alternately arranged along the at least one flow channel on one side and the other side of the at least one flow channel in the stacking direction.

The fins may be perpendicular to the longitudinal direction of the at least one flow channel in which the fin structure is installed. The fins may be inclined with respect to the longitudinal direction of the at least one flow channel in which the fin structure is installed. Some of the fins may be arranged at a different pitch from the other of the fins. The fin structure may include a pair of strips configured to support the fins, provided on both sides of the arrangement of the fins in a direction intersecting the stacking direction.

The fin structure may include: a pair of strips provided on both sides of the arrangement of the fins in a direction intersecting the stacking direction; and support portions configured to link the pair of strips, provided between the pair of strips, and connected to a corresponding one of the fins. The fin structure may be integrally formed of a single plate member.

The fin structure may include connection portions supported by the pair of strips, configured to connect the fins so that the fins meander in a direction intersecting the stacking direction. The fins and the connection portions may be integrally formed of a single plate member. A catalyst may be supported on the fin structure.

According to the present disclosure, it is possible to provide a heat exchange structure capable of improving the overall heat transfer coefficient between two fluids in a space with a limited length.

BRIEF DESCRIPTION OF THE DRAWINGS

FIG. 1A is the view illustrating a cross section of the heat exchange structure in a Y-Z plane. FIG. 1B is a cross section along the line IB-IB shown in FIG. 1A.

FIG. 4A is a perspective view of the first configuration example, and FIG. 4B is a cross-sectional view in a plane IVB shown in FIG. 4A.

FIG. 5A is a perspective view of the second configuration example, and FIG. 5B is a cross-sectional view in a plane VB shown in FIG. 5A.

FIG. 6A is a perspective view of the third configuration example, and FIG. 6B is a cross-sectional view in a plane VIB shown in FIG. 6A.

FIG. 7A a perspective view of the fourth configuration example, and FIG. 7B is a cross-sectional view in a plane VIIB shown in FIG. 7A.

FIG. 8A is a perspective view of the fifth configuration example, and FIG. 8B is a cross-sectional view in a plane VIIIB shown in FIG. 8A.

FIG. 9A is a perspective view of the sixth configuration example, and FIG. 9B is a cross-sectional view in a plane IXB shown in FIG. 9A.

FIG. 10A is a perspective view of the first example of the bent portion, and FIG. 10B is a perspective view of the second example of the bent portion.

DESCRIPTION OF THE EMBODIMENTS

Figure 1A:
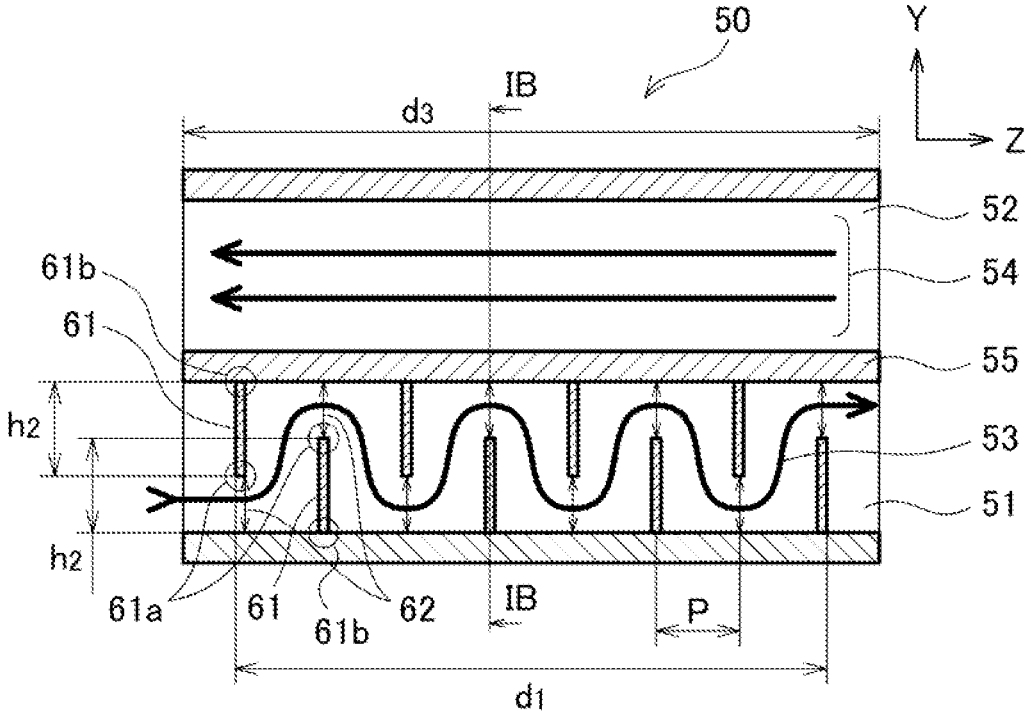
FIGS. 1A and 1B are views illustrating a basic configuration of a heat exchange structure according to the present disclosure.

Embodiments according to the present disclosure are described below with reference to the drawings. In the drawings, common parts are denoted by the same symbols and redundant explanations thereof will be omitted.

(Basic Configuration)

A basic configuration of a heat exchange structure 50 according to the present embodiment will be described. Hereafter, for convenience of explanation, X, Y and Z directions are defined as three directions perpendicular to one another. As described later, the Y direction is a stacking direction of two flow channels 51 and 52. The Z direction is a longitudinal direction (extending direction) of each channel. The X direction is a width direction of each channel and is also an arrangement direction when multiple channels are provided in parallel.

Figure 1B:
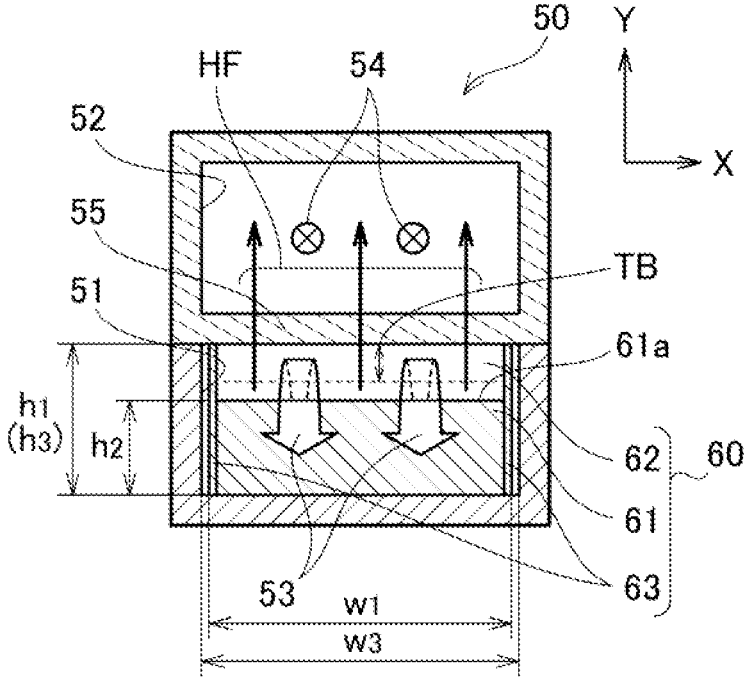
Figure 2:
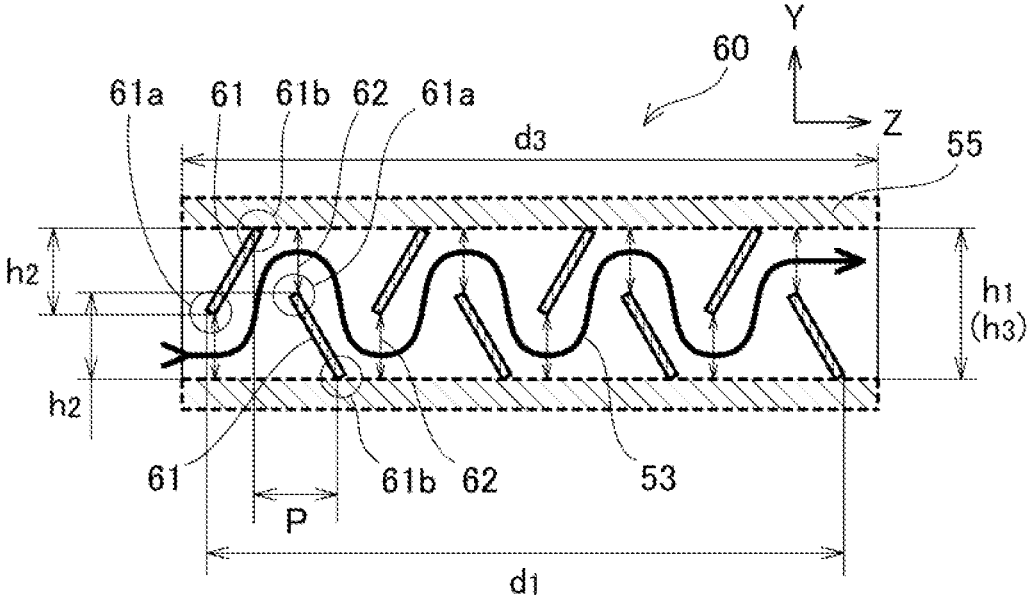
FIG. 2 is a view illustrating a modification of the basic configuration of the heat exchange structure.

FIGS. 1A and 1B are views illustrating a basic configuration of a heat exchange structure 50 according to the present embodiment. FIG. 1A is the view illustrating a cross section of the heat exchange structure 50 in the Y-Z plane. FIG. 1B is a cross section along the line IB-IB shown in FIG. 1A. FIG. 2 is a view illustrating a modification of the basic configuration of the heat exchange structure 50.

As shown in FIG. 1A, the heat exchange structure 50 includes at least one flow channel 51 and at least one flow channel 52. The flow channels 51 and 52 have a width w3 along the X direction and extend in the Z direction, which is the longitudinal direction. The flow channels 51 and 52 are stacked along the Y direction (i.e., the stacking direction). The flow channel 51 and the flow channel 52 are provided parallel and thermally connected to each other through a partition 55. The flow channel 51 is applied as one of a first flow channel 11 and a second flow channel 21 described later, and the flow channel 52 is applied as the other of the first flow channel 11 and the second flow channel 21. The partition 55 between the flow channel 51 and the flow channel 52 corresponds to a first partition 13 or a second partition 23, which will be described later.

The heat exchange structure 50 may be provided with multiple flow channels 51 and multiple flow channels 52. For example, the flow channels 51 are parallel to each other on a plane parallel to the X-Z, plane, and the flow channels 52 are parallel to each other on the plane parallel to the X-Z plane. The longitudinal directions of the flow channel 51 and the flow channel 52 may be parallel to each other or may intersect with each other. That is, the latter may have a skewed relationship. In both cases, one of the flow channels 51 and 52 is thermally connected to the other of the flow channels 51 and 52 through the partition 55 in most of the sections in the longitudinal directions of the channels.

As shown in FIG. 1A, fluid 53 flows in the flow channel 51 and fluid 54 flows in the flow channel 52. The fluid 53 is one of a heat medium M and a reaction fluid R described later. The fluid 54 is the other of the heat medium M and the reaction fluid R. The flow of the fluid 53 and the fluid 54 may be countercurrent or parallel (co-current).

There is a temperature difference ΔT, between fluid 53 and fluid 54. Therefore, when fluid 53 flows through flow channel 51 and fluid 54 flows through flow channel 52, heat is transferred between the fluid 53 and the fluid 54. Specifically, the heat is transferred between the fluid 53 and the fluid 54 due to convection between the fluid 53 and the partition 55, thermal conduction within the partition 55, and convection between the partition 55 and the fluid 54.

In this case, the amount of heat Q per unit time is proportional to the product of the overall heat transfer coefficient (heat transfer rate) U, the heat transfer area A of the partition 55, and the temperature difference ΔT between the fluid 53 and the fluid 54. That is, the relationship among these values is expressed by the following formula (1):

$$Q=UA(\Delta T) \tag{1}$$

Here, the heat transfer area A is constant. Since the fluid 53 and the fluid 54 flow steadily, the change in the temperature difference ΔT is small. Therefore, it is found that the increase in amount of heat Q is obtained by increasing the overall heat transfer coefficient U.

There is also the following relationship among the overall heat transfer coefficient U, the heat transfer coefficient H1 between the fluid 53 and the partition 55, the heat transfer coefficient H2 between the partition 55 and the fluid 54, and the thermal conductivity K of the partition 55, $$1/U=1/H1+1/H2+T/K \tag{2}$$

where T is the thickness of the partition 55.

From the formula (2), it is found that the overall heat transfer coefficient U increases when at least one of the heat transfer coefficients H1 and H2 increases.

The heat transfer coefficient H1 increases by accelerating the fluid 53 near the partition 55. This trend is the same for the heat transfer coefficient H2. In the present embodiment, using a fin structure 60, a main flow of at least one of the fluids 53 and 54 is directed to the partition 55. This allows a portion of the main flow to approach or enter the temperature boundary layer near the partition 55, thereby promoting the heat transfer between the main flow and the partition 55. That is, at least one of the heat transfer coefficient H1 and the heat transfer coefficient H2 increases. As a result, the overall heat transfer coefficient U increases, and eventually the amount of heat Q increases. That is, the overall heat transfer coefficient between two fluids can be improved in a space with a limited length.

The fin structure 60 according to the present embodiment is detachably installed in at least one of the flow channels 51 and 52. For convenience of explanation, the fin structure is described below using an example shown in FIG. 1A and FIG. 1B. That is, the fin structure 60 is installed in the flow channel 51, but it is not installed in the flow channel 52.

As shown in FIG. 1B, the fin structure 60 has a width w1 in the X direction and a height h1 in the Y direction. The width w1 of the fin structure 60 is set to a value approximately equal to the width w3 of the flow channel 51. Also, the height h1 of the fin structure 60 is set to a value less than or equal to a height h3 of the flow channel 51. The width w1 is set to a value that minimizes leakage between the fin structure 60 and the inner surface of the flow channel 51. The height h1 may be set to such a value that a clearance for preventing stagnation of the fluid 53 is formed. A depth d1 of the fin structure 60 is appropriately set according to the dimensions of the flow channel 51 and the usage condition thereof. For example, depth d1 is set to a value less than or equal to depth d3 of flow channel 51.

The fin structure 60 includes multiple fins (deflection plates, partition plates) 61. The fin 41 is a substantially rectangular piece of a thin metal plate. The metal plate faces in the Z direction and extends in the X direction. The pitch (interval) P between the two fins 61 and 61 adjacent to each other may be constant or varied. That is, some of the fins 61 may be arranged at a different pitch P from the other of the fins 61. By varying the pitch P, it is possible to vary the local overall heat transfer coefficient along the Z direction.

As shown in FIG. 1B, the fin 61 has an edge 61*a* which extends in the X direction. At the edge 61*a*, the fin 61 has a height h2 in the Y direction. The height h2 is set to a value less than the height h3 of the flow channel 51 and greater than or equal to a half of the height h3. The difference between the height h3 of the flow channel 51 and the height h2 of the fin 61 forms an opening 62 inside the flow channel 51. That is, the fins 61 form the openings 62 between the edges 61*a* and the inner circumferential surface (i.e., the partition 55) of the flow channel 51. As described later, the fluid 53 flows in the flow channel 51 through the openings 62.

Figure 11:
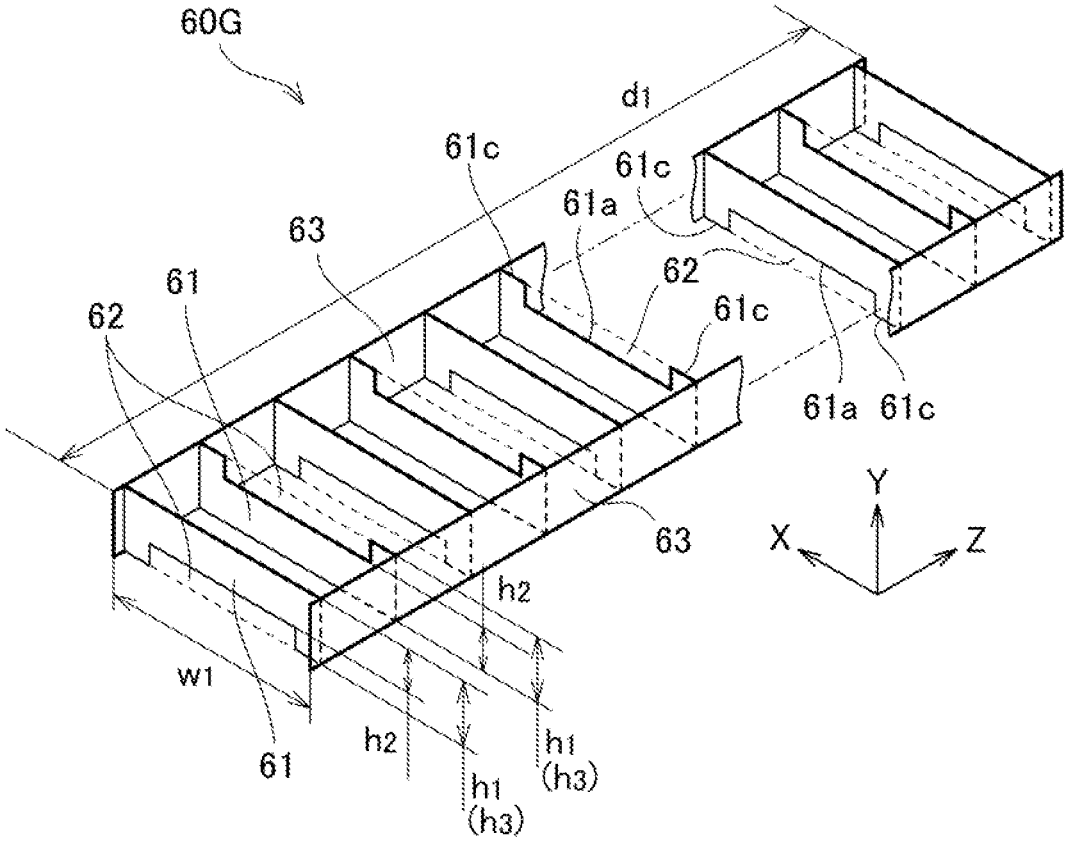
FIG. 11 is a view illustrating a seventh configuration example of the fin structure according to the present disclosure.
Figure 12:
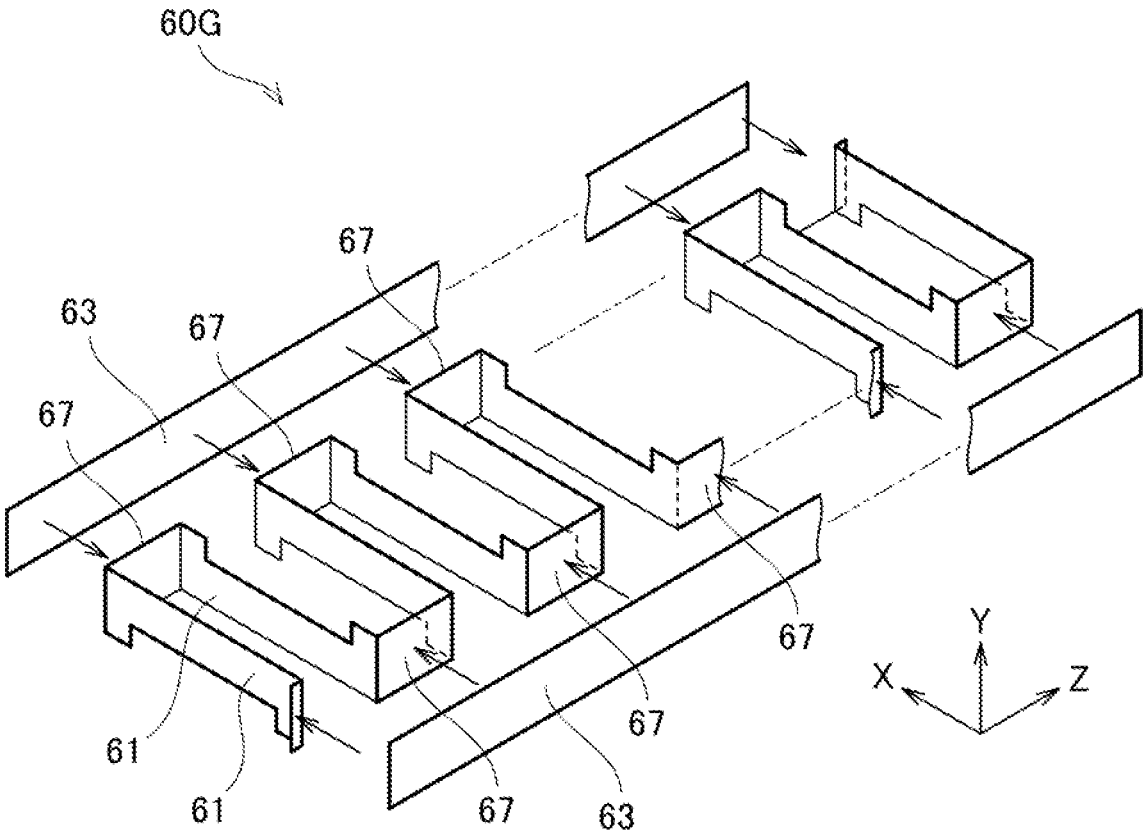
FIG. 12 is a view illustrating a seventh configuration example of the fin structure according to the present disclosure.

As shown in FIG. 12, the edge 61*a* may be formed over the entire range in the X direction. Otherwise, the edge 61*a* may be formed in a partial range in the X direction (see FIG. 11). In the former case, the fins 61 are alternately arranged along the Z direction on one side and the other side of the flow channel 51 in the Y direction. In the latter case, the fins 51 are arranged along the Z direction so that the positions of the edges 61*a* are alternately located along the Z direction on one side and the other side of the flow channel 51 in the Y direction.

As shown in FIG. 1A, the fins 61 may be perpendicular to the longitudinal direction (i.e., the Z direction) of the flow channel 51. Alternatively, as shown in FIG. 2, the fin 61 may be inclined with respect to the longitudinal direction of the flow channel 51. In the latter case, the fin 61 may be inclined so that the edge 61*a* forming the opening 62 is located upstream of the flow channel 51 from the opposite edge 61*b*, or vice versa.

Figure 3A:
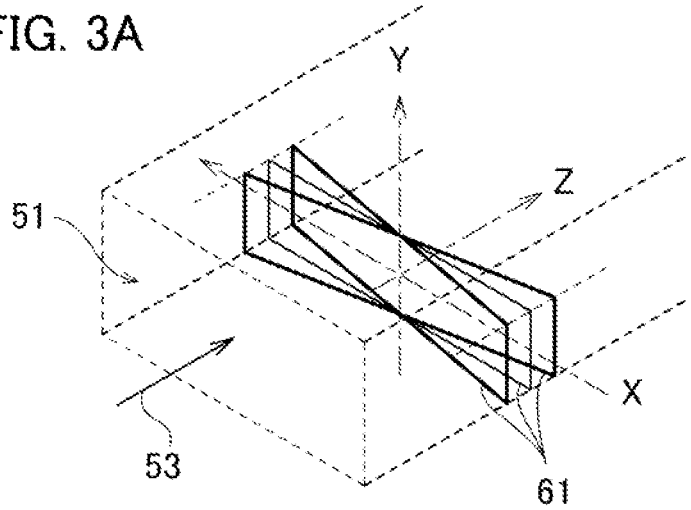
FIGS. 3A to 3C are views illustrating examples of fin arrangements according to the present disclosure.
Figure 3B:
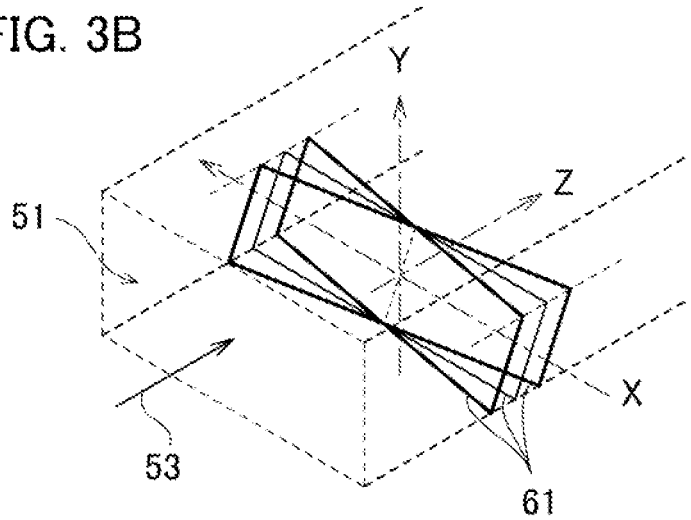
Figure 3C:
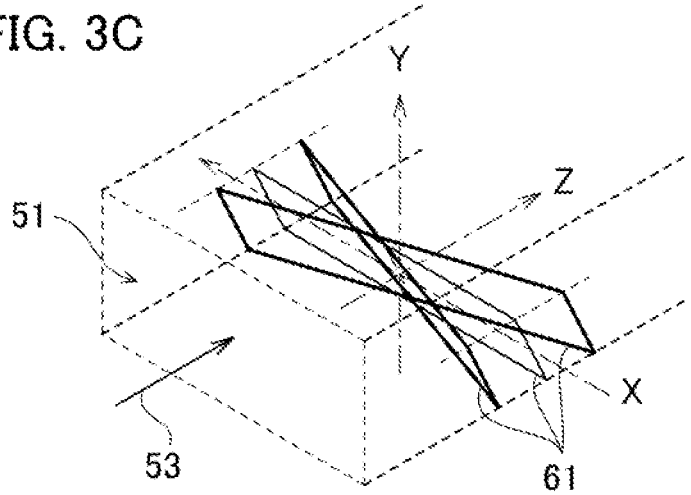

FIGS. 3A to 3C are views illustrating examples of arrangements of the fins 61. As shown in these figures, the fin 61 may be inclined with respect to the X direction. When the fin 61 is inclined with respect to the X direction, the fin 61 may be perpendicular to a plane including the width direction and the longitudinal direction of the flow channel 51 as shown in FIG. 3A or inclined with respect to the plane including the width direction and the longitudinal direction of the flow channel 51 as shown in FIG. 3B and FIG. 3C. In addition, the flow channel 51 may include a mix of the perpendicular or inclined fins 61 described above.

The fin structure 60 includes a pair of strips 63 and 63. Each of the pair of strips 63 and 63 is provided on both sides of the arrangement of the multiple fins 61 in the direction intersecting the Z direction (e.g., the X direction). The pair of strips 63 and 63 support the multiple fins 61 located between them. However, the fins 61 may be supported by a member linking the pair of strips 63 and 63 (e.g., a support portion 66 shown in FIG. 8A) or a member having the pair of strips 63 and 63 as the side surfaces (e.g., a square tube 64 shown in FIG. 4A).

As described above, the openings 62 open toward the Z direction (longitudinal direction) of the flow channel 51 and are alternately arranged along the flow channel 51 on one side and the other side of the flow channel 51 in the Y direction (stacking direction). That is, the openings 62 are arranged zigzag along the Z direction so as to reciprocate in the Y direction. Therefore, the fluid 53 flows in the Z direction while repeating the reciprocation in the Y direction. In other words, the fluid 53 flows in the Z direction with meandering in the Y direction.

The fin structure 60 has no structure interfering with heat transfer at least in part between the path of the meandering fluid 53 and the partition 55. In other words, the fin structure 60 has a portion (i.e., an opening) which exposes the fluid 53 to the partition 55 in each interval in which the fluid 53 reciprocates in the Y direction. Therefore, part of the fluid 53 can directly approach or enter the temperature boundary layer TB near the partition 55. Accordingly, it is possible to increase the heat transfer coefficient H1 and to improve the heat transfer coefficient between the fluid 53 and the fluid 54. For example, if the temperature of the fluid 53 is higher than the temperature of the fluid 54, the heat flow HF shown in FIG. 1B can be promoted.

A similar improvement in overall heat transfer coefficient can also obtained by placing the fin structure 60 in the flow channel 52. That is, the heat transfer coefficient H2 can be increased by installing the fin structure 60 in the flow channel 52. Further, by installing a fin structure 60 in each of the flow channels 51 and 52, the heat transfer coefficient between the fluid 53 and the fluid 54 can be further improved. In any cases, the overall heat transfer coefficient between the fluid 53 and the fluid 54 can be improved by placing the fin structure 60 in a space with a limited length.

The fin structure 60 is formed of a heat-resistant material that can support a catalyst. Such materials include heat-resistant alloys mainly composed of one or more kinds of metals such ah Fe (iron), Cr (chromium), Al (aluminum), Y (yttrium), Co (cobalt), Ni (nickel), Mg (magnesium), Ti (titanium), Me (molybdenum), W (tungsten), Nb (niobium), and Ta (tantalum). For example, the fin structure 60 may be formed by molding a thin-plate structural material made of a heat-resistant alloy such as Fecralloy® or the like.

When a catalyst is supported on the fin structure 60, the catalyst contains as a main component an active metal effective for promoting the progress of chemical reactions. The active metal is, for example, (nickel), Co (cobalt), Fe (iron), Pt (platinum), Ru (ruthenium), Rh (rhodium), and/or Pd (palladium). Only one of these metals may be used, or a combination of several of these metals may be used as long as they are effective in promoting the reaction.

1st Configuration Example

Figure 4A:
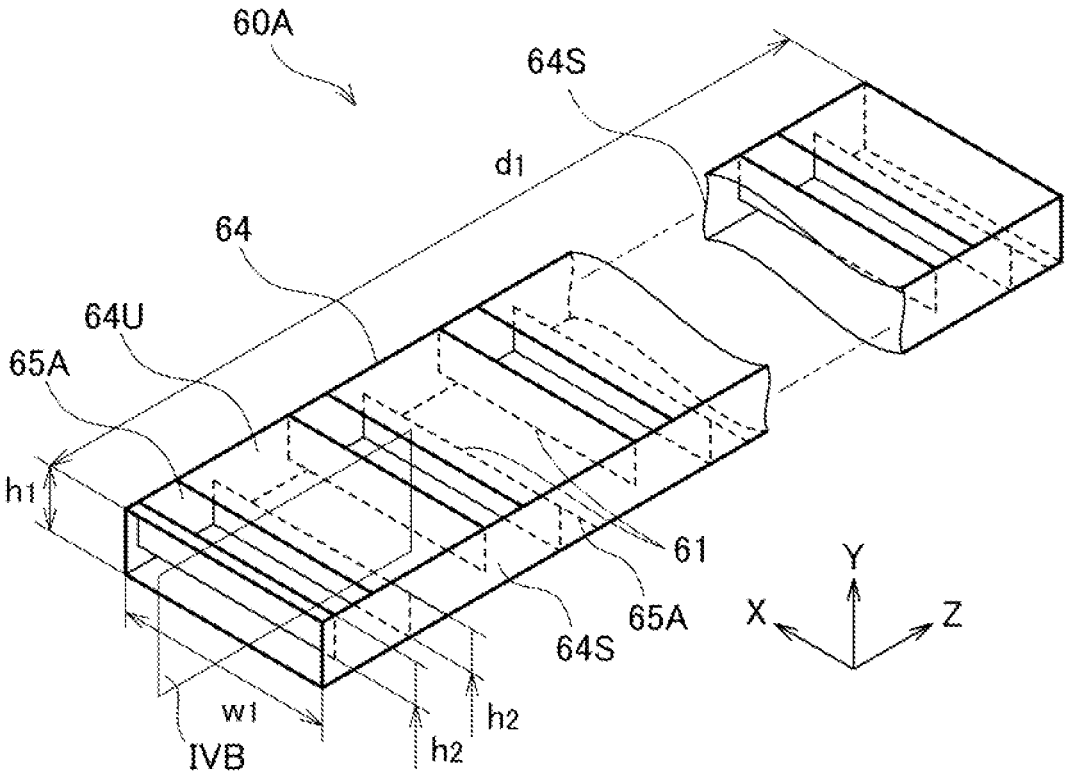
FIGS. 4A and 4B are views illustrating a first configuration example of the fin structure according to the present disclosure.
Figure 4B:
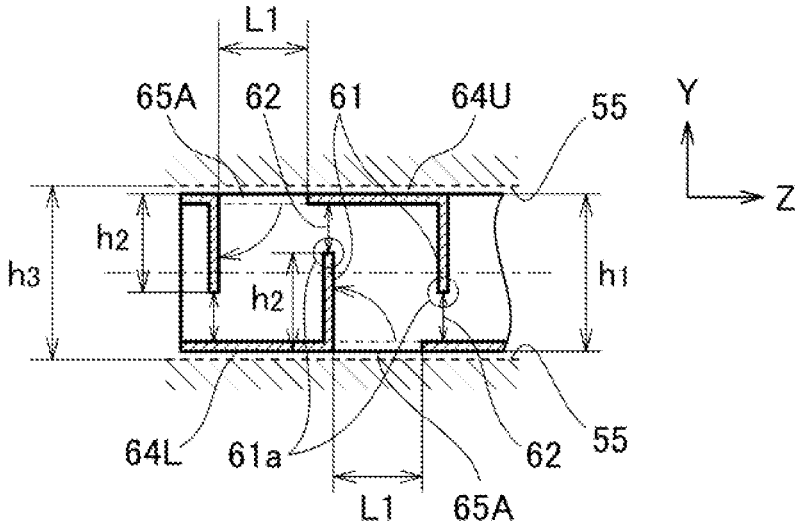

Next, a configuration example of the fin structure 60 will be described. FIGS. 4A and 4B are views illustrating the fin structure 60A as a first configuration example of the fin structure 60. FIG. 4A is a perspective view of the first configuration example, and FIG. 4B is a cross-sectional view in a plane IVB shown in FIG. 4A.

As shown in FIG. 4A, the fin structure 60A is formed of a square tube 64 having a height h1, a width w1 and a depth d1. The square tube 64 has an upper surface 64U and a lower surface 64L that are spaced apart in the Y direction by the height h1. The square tube 64 has two side surfaces 64S and 64S that are spaced apart in the X direction by the width w1. These two side surfaces 64S and 64S constitute the pair of strips 63 and 63 described above, and the upper surface 64U and the lower surface 64L function as linking members between the side surfaces 64S and 64S.

The upper surface 64U and the lower surface 64L are cut and bent toward the inside of the square tube 64 to form multiple fins 61. That is, the multiple fins 61 are bent from the upper surface 64U or the lower surface 64L to be perpendicular to the Z direction while being supported by the upper surface 64U or the lower surface 64L. Note that a height h2 of the fin 61 is approximately equal to a length L1 of an exposed portion 65A in the Z direction.

As a result of the lancing process described above, an exposed portion 65A opens on the upper surface 64U. The exposed portion 65A is located behind (or in front of) the fin 61 in the Z direction and exposes the internal space of the square tube 64, through which the fluid 53 flows, to the partition 55. With this exposure, the overall heat transfer coefficient between the fluid 53 and the fluid 54 is improved.

The fin structure 60A is formed by the lancing process for the square tube 64. That is, the multiple fins 61 are integrally formed with the square tube 64. Since the main processing is only the lancing process, the fin structure 60A can be easily manufactured.

2nd Configuration Example

Figure 5A:
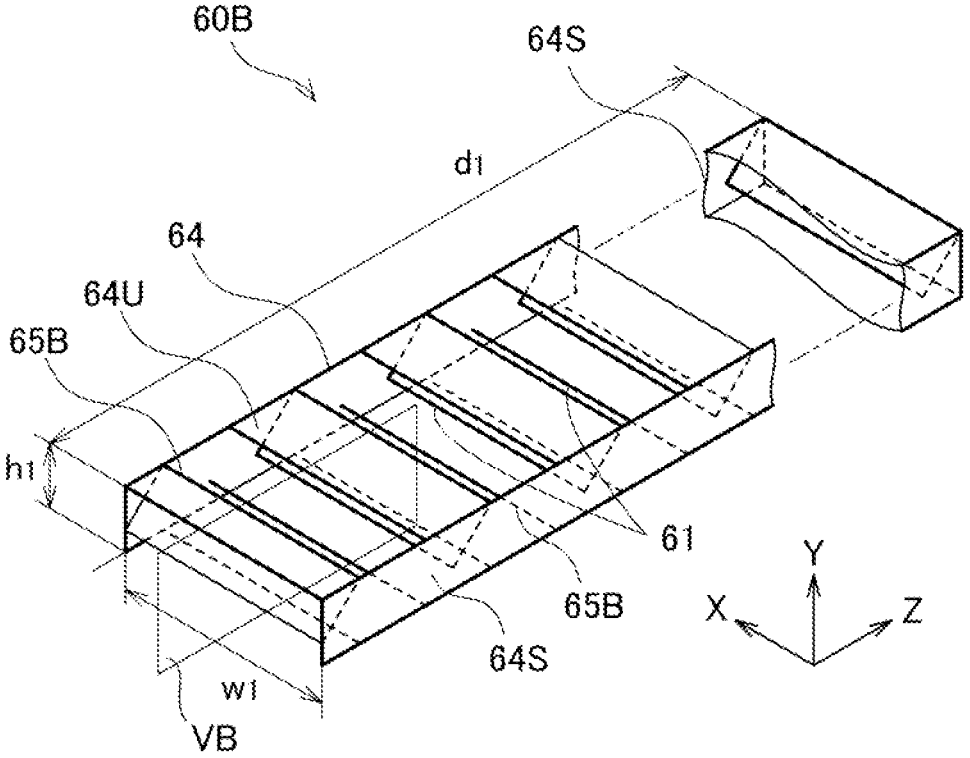
FIGS. 5A and 5B are views illustrating a second configuration example of the fin structure according to the present disclosure.
Figure 5B:
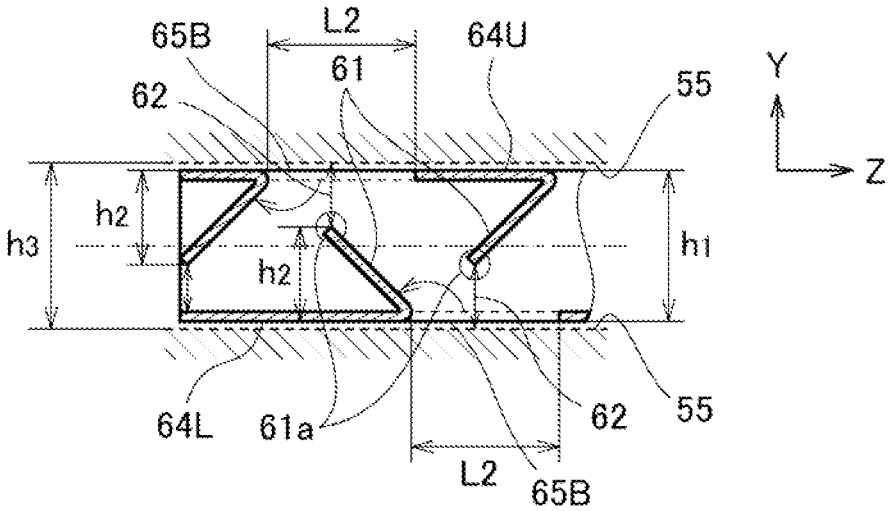

FIGS. 5A and 5B are views illustrating a fin structure 60B as a second configuration example of the fin structure 60. FIG. 5A is a perspective view of the second configuration example, and FIG. 5B is a cross-sectional view in a plane VB shown in FIG. 5A. The difference of the second configuration from the first configuration is that the fins 61 of the fin structure 60B are inclined with respect to the Z direction. Other configurations in the second configuration example are the same as those in the first configuration example.

A height of the fin 61 as seen from the Z direction is set to the height h2 described above. Therefore, by tilting the fin 61 with respect to the Z direction, it is possible to set a length L2 of the exposed portion 65B in the Z direction longer than the length L1. That is, it is possible to increase the opening area of the exposed portion 65B than the opening area of the exposed portion 65A. Therefore, at least the overall heat transfer coefficient in the exposed portion 65B can be improved.

3rd Configuration Example

Figure 6A:
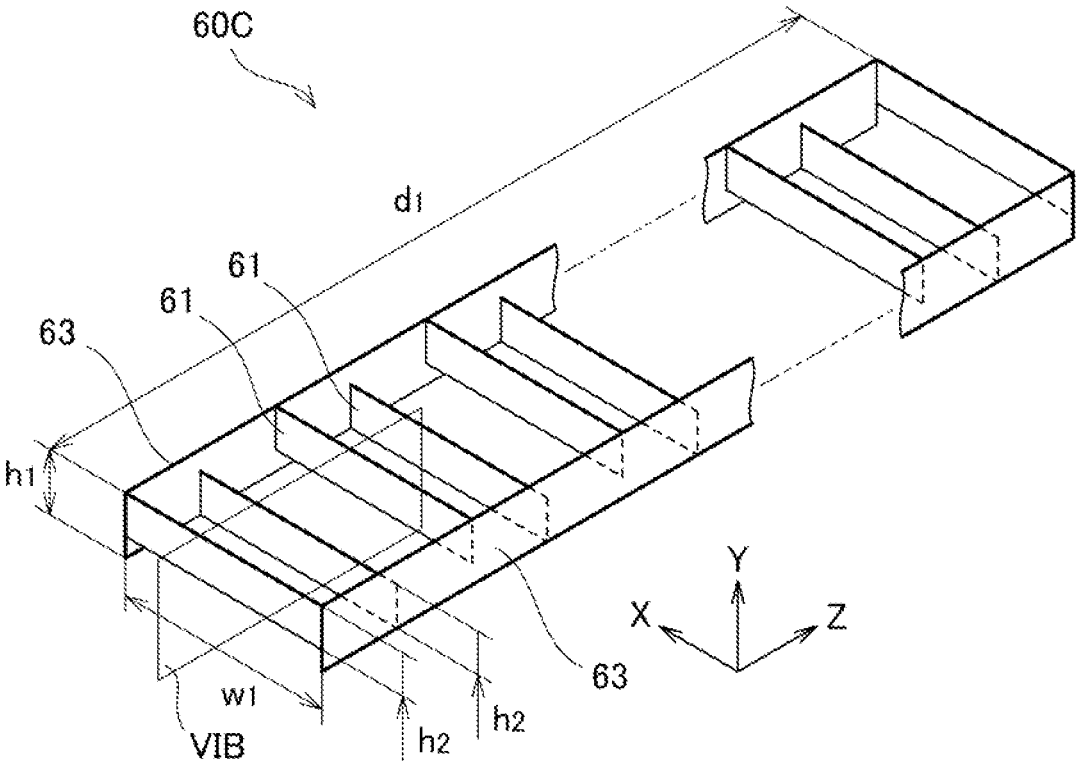
FIGS. 6A and 6B are views illustrating a third configuration example of the fin structure according to the present disclosure.
Figure 6B:
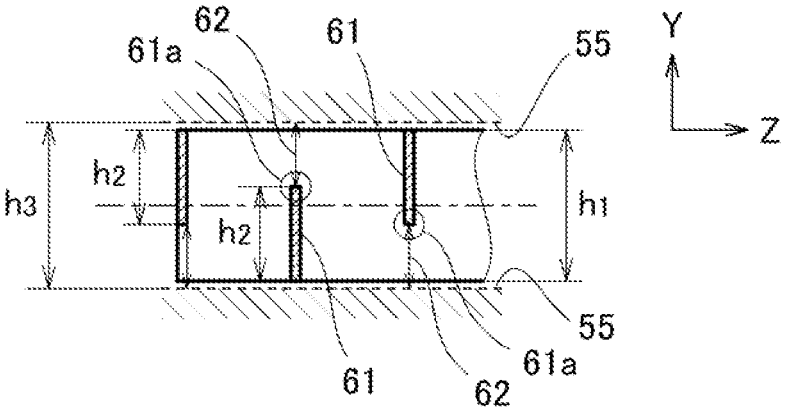

FIGS. 6A and 6B are views illustrating a fin structure 60C as a third configuration example of the fin structure 60. FIG. 6A is a perspective view of the third configuration example, and FIG. 6B is a cross-sectional view in a plane VIB shown in FIG. 6A. The fin 61 of the fin structure 60C as the third configuration example is perpendicular to the Z direction and has an edge 61*a* formed over the entire range in the X direction. That is, the fin 61 has the height h2 over the entire range in the X direction and forms the opening 62 between the fin 61 and the inner circumferential surface (i.e., the partition 55) of the flow channel 51.

The fin structure 60C includes the pair of strips 63 and 63. That is, each of the pair of strips 63 and 63 is provided on both sides of the arrangement of the multiple fins 61 in the direction (e.g., the X direction) intersecting the Z direction. The pair of strips 63 and 63 connect to both ends of the fins 61 in the X direction and support the fins 61 located between the pair of strips 63 and 63.

4th Configuration Example

Figure 7A:
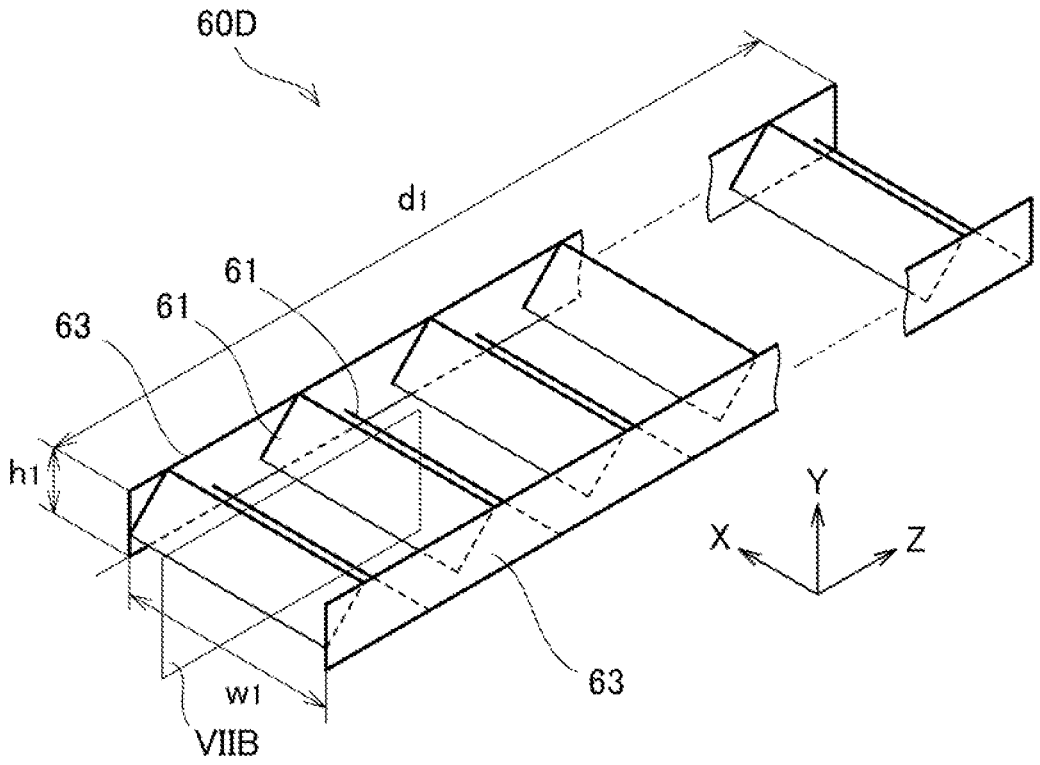
FIGS. 7A and 7B are views illustrating a fourth configuration example of the fin structure according to the present disclosure.
Figure 7B:
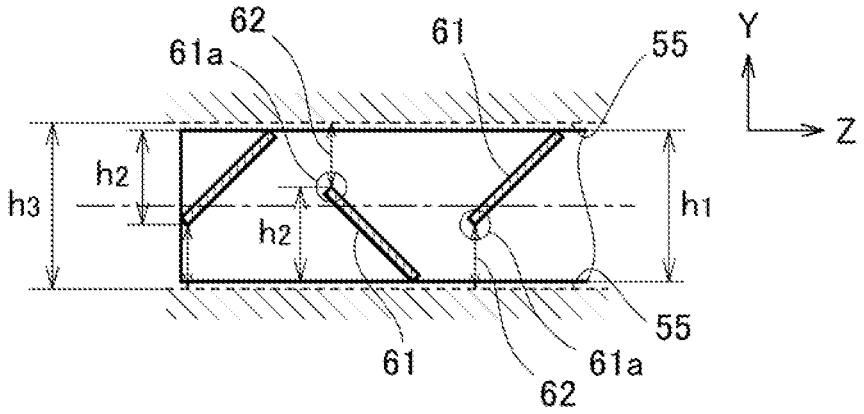

FIGS. 7A and 7B are views illustrating a fin structure 60D as a fourth configuration example of the fin structure 60. FIG. 7A is a perspective view of the fourth configuration example, and FIG. 7B is a cross-sectional view in a plane VIIB shown in FIG. 7A. The fin 61 of the fin structure 60D is inclined with respect to the Z direction and has an edge 61*a* formed over the entire range in the X direction. That is, the fin 61 has the height h2 as seen from the Z direction in the entire X direction and forms an opening 62 between the fin 61 and the inner circumferential surface (i.e., the partition 55) of the flow channel 51.

As same as the third configuration, the fin structure 60D includes the pair of strips 63 and 63. That is, each of the pair of strips 63 and 63 is provided on both sides of the arrangement of the multiple fins 61 in the direction (e.g., the X direction) intersecting the Z direction. The pair of strips 63 and 63 connect to both ends of each fin 61 in the X direction and support the fins 61 located between the pair of strips 63 and 63.

The fin structures 60C and 60D of the third and fourth configuration examples do not have a structure that separates the inner space of the flow channel 51, through which the fluid 53 flows, from the partition 55. Thus, the partition 55 is exposed to the fluid 53 almost throughout the Z direction. Therefore, it is possible to improve the overall heat transfer coefficient between the fluid 53 and the fluid 54 over that in the first and second configuration examples.

5th Configuration Example

Figure 8A:
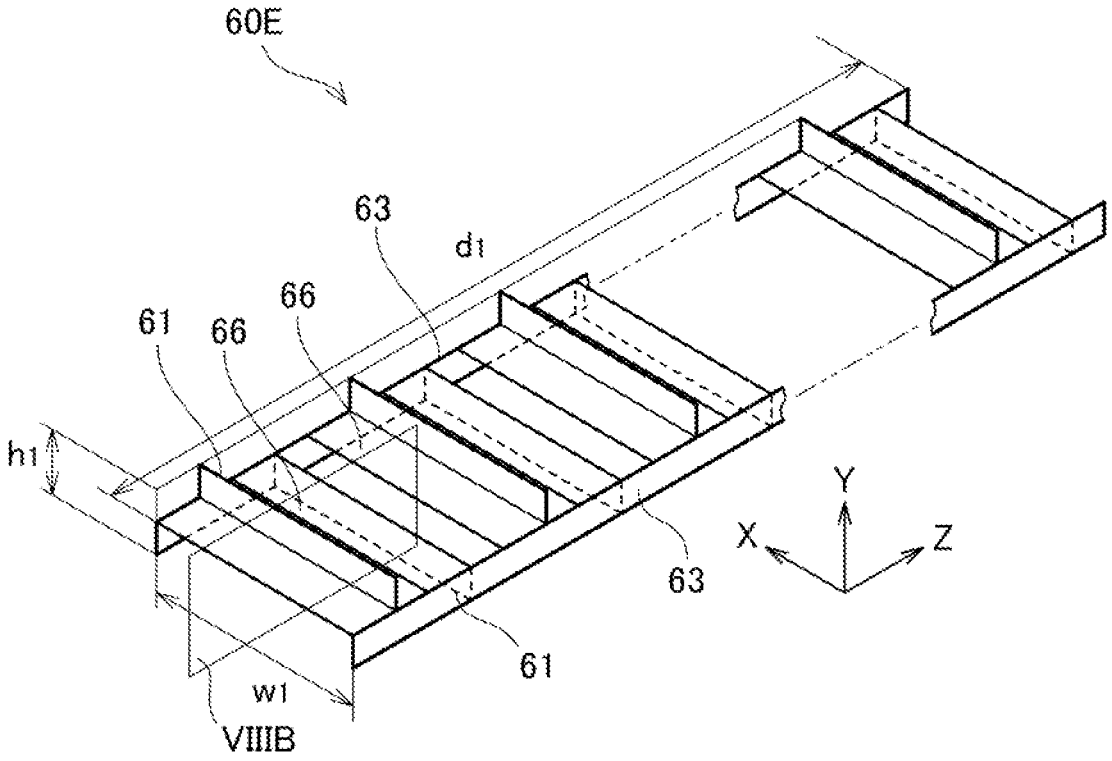
FIGS. 8A and 8B are views illustrating a fifth configuration example of the fin structure according to the present disclosure.
Figure 8B:
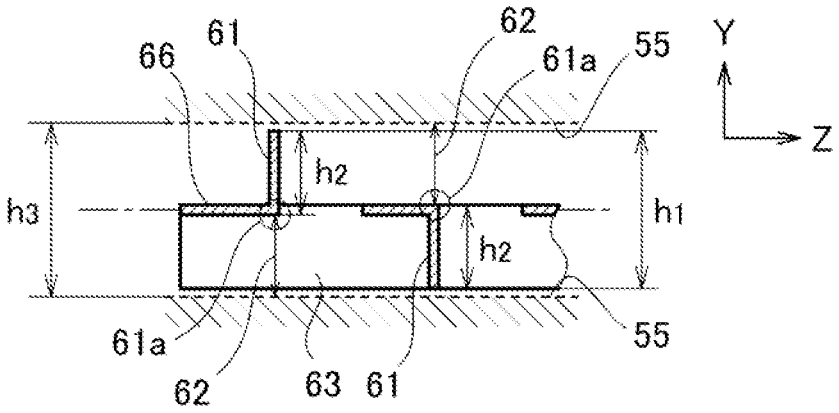

FIGS. 8A and 8B are views illustrating a fin structure 60E as a fifth configuration example of the fin structure 60. FIG. 8A is a perspective view of the fifth configuration example, and FIG. 8B is a cross-sectional view in a plane VIIIB shown in FIG. 8A. As same as the configuration examples described above, the fin structure 60E also includes the pair of strips 63 and 63. However, the pair of strips 63 and 63 do not directly support the fins 61. Instead, multiple support portions 66 support the fins 61.

The fin structure 60E includes the support portions 66 described above. The support portions 66 are provided between the pair of strips 63 and 63 and link the pair of strips 63 and 63. The support portion 66 is also connected to the corresponding one of the multiple fins 61. The connection between the fin 61 and the support portion 66 constitutes an edge 61*a* forming the opening 62.

As shown in FIG. 8B, the support portion 66 is located at the center of the flow channel 51 in the Y direction, for example. The multiple fins 61 extend alternately toward one side and the other side in the Y direction from the support portions 66 as the starting points.

6th Configuration Example

Figure 9A:
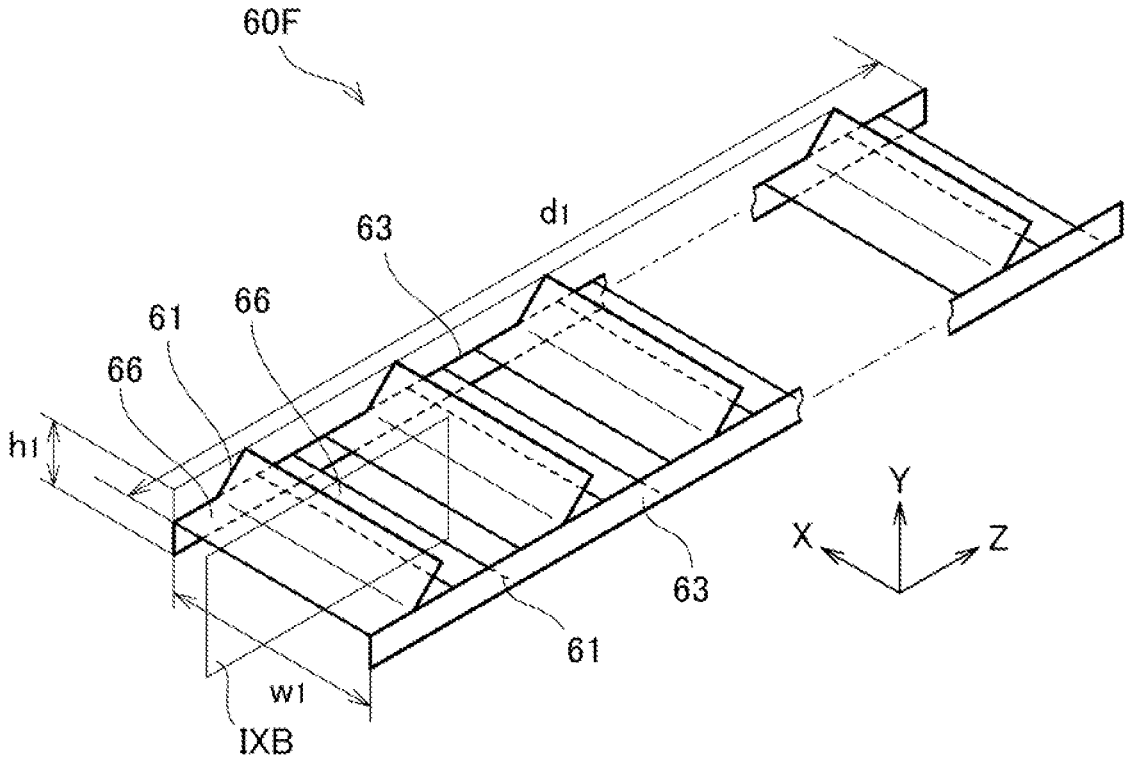
FIGS. 9A and 9B are views illustrating a sixth configuration example of the fin structure according to the present disclosure.
Figure 9B:
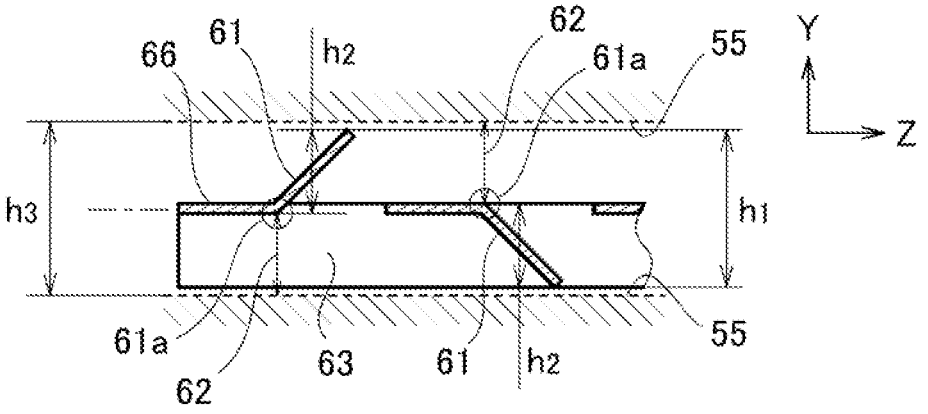

FIGS. 9A and 9B are views illustrating a fin structure 60F as a sixth configuration example of the fin structure 60. FIG. 9A is a perspective view of the sixth configuration example, and FIG. 9B is a cross-sectional view in a plane IXB shown in FIG. 9A. The fins 61 of the fin structure 60F are inclined with respect to the Z direction. Other configurations are identical to those of the fin structure 60E.

As similar to the third and fourth configuration examples, the fin structures 60E and 60F of the fifth and sixth configuration examples do not have a structure that separates the inner space of the flow channel 51, through which the fluid 53 flows, from the partition 55. Thus, the partition 55 is exposed to the fluid 53 almost throughout the Z direction. Therefore, it is possible to improve the overall heat transfer coefficient between the fluid 53 and the fluid 54 over that in the first and second configuration examples.

In the fin structures 60E and 60F, the connection between the fin 61 and the support portion 66 serves as the fulcrum of the fin 61. Therefore, when the fin structures 60E and 60F are attached to or detached from the flow channel 51, even if the fin 61 contacts with the inner circumferential surface (i.e., the partition 55) of the flow channel 51 (in other words, even if the friction increases), the fin 61 can be bent around the fulcrum. That is, it becomes easier to attach and detach the fin structure.

In addition, since the fins 61 can be bent during the attachment and the detachment, the height h2 of the fins 61 can be set as high as possible to suppress leakage between the fin structures 60E and 60F and the inner circumferential surface (i.e., the partition 55) of the flow channel 51 as much as possible. In this case, since the fins 61 may contact the inner circumferential surface (i.e., the partition 55) of the flow channel 51, it is also possible to partially achieve heat conduction between the fins 61 and the inner circumferential surface (i.e., the partition 55) of the flow channel 51.

The fin structure 60E of the fifth configuration example and the fin structure 60F of the sixth configuration example are structurally capable of being formed by punching and bending a single plate member without a connecting process such as welding. For example, the fins 61 and strip 63 are formed by bending a part of a single plate member that becomes the support portion 66. With the aforementioned formation of such a single plate member, the number of components and the number of the machining processes can be reduced.

Figure 10A:
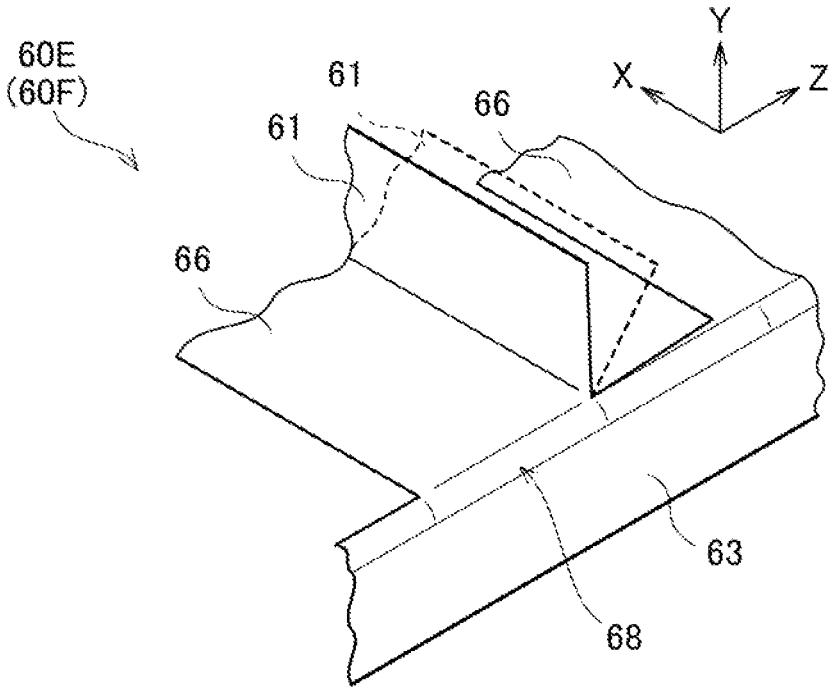
FIGS. 10A and 10B are perspective views illustrating a bent portion in the fifth and sixth configuration examples.
Figure 10B:
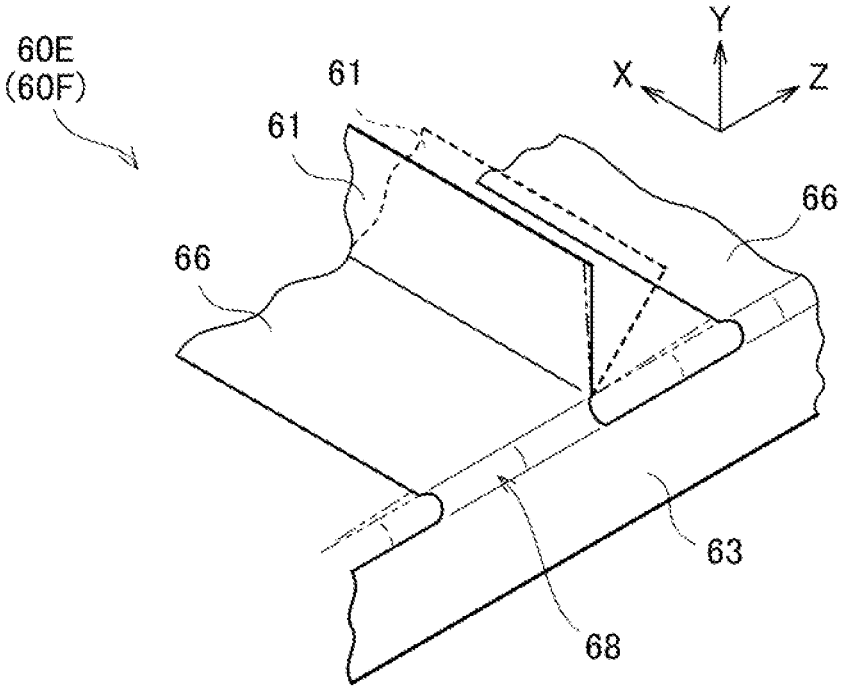

FIGS. 10A and 10B are perspective views illustrating a bent portion 68 in the fifth and sixth configuration examples. FIG. 10A is a view illustrating a first example of the bent portion 68. FIG. 10B is a view illustrating a second example of the bent portion 68. As described above, the fin structure 60E and the fin structure 60F can be formed by punching and bending a single plate member. In this case, the strip 63 and the support portion 66 are connected to each other via the bent portion 68 formed by bending the plate member.

The bent portion 68 may be formed over the entire range in the Z direction as shown in FIG. 10A. Otherwise, it may be formed only at a position between the strip 63 and the support portion 66 in the Z direction as shown in FIG. 10B. The former is easier to process than the latter. On the other hand, the latter makes it easier than the former to keep the width of the fin 61 constant across the Y direction and to reduce the leakage from between the fin 61 and the flow channel 51. The dash-dotted line in FIG. 10B illustrates part of the outlines of the fin 61 and the bent portion 68 shown in FIG. 10A.

7th Configuration Example

FIGS. 11 and 12 are views illustrating a fin structure 60G as a seventh configuration example of the fin structure 60. The fin 61 of the fin structure 60G includes an edge 61*a* having the height h2 in a partial range in the X direction. In other ranges, an edge 61*c* is formed. The edge 61*c* has a height similar to the height h1 of the flow channel 51.

As same as the other configuration examples, the edge 61*a* forms the opening 62 between the edge 61*a* and the inner circumferential surface (i.e., the partition 55) of flow channel 51. As shown in FIG. 11, the fins 61 are arranged along the Z direction so that the edges 61*a* are located alternately on one side and the other side of the flow channel 51 in the Y direction.

As shown in FIG. 11, the fin structure 60G includes a pair of strips 63 and 63. That is, each of the pair of strips 63 and 63 is provided on both sides of the arrangement of the multiple fins 61 in the direction (e.g., the X direction) intersecting the Z direction. The pair of strips 63 and 63 connect to both ends of the fins 61 in the X direction and support the fins 61 located between the pair of strips 63 and 63.

As shown in FIG. 12, the fin structure 60G may include multiple connection portions 67 connecting the multiple fins 61. The connection portions 67 are supported by the pair of strips 63 and 63. In addition, the connection portions 67 connect the fins 61 so that the fins 61 meander in a direction (e.g., X direction) intersecting the Y direction. In this case, the connection portions 67 and the fins 61 may be integrally formed from a single plate member. That is, the connection portions 67 and the fins 61 may be integrally formed by punching and bending a single pate member formed into a strip. With this integral formation, the number of components and the number of the machining processes can be reduced.

Application Example

The fin structure 60 can efficiently transfer heat in the direction in which the fluid meanders. For example, assuming a configuration in which an assembly of parallel flow channels 51 and an assembly of parallel flow channels 52 are stacked on each other, heat moves mainly along the Y direction between fluids 53 and 54. Therefore, heat exchange can be improved by using the fin structure 60. The reactor (catalytic reactor) described below is designed with taking into consideration this point.

Hereinafter, a reactor (catalytic reactor) 1 is described as an example to which the heat exchange structure 50 is applied. The reactor 1 includes a heat exchange section 2 as the heat exchange structure 50. As described later, first heat transfer bodies 10 and second heat transfer bodies 20 are stacked in the Y direction, and first flow channels (channels) 11 and second flow channels (channels) 21 extend in the Z direction. In addition, the width direction of each channel is taken as the X direction described above. The X direction is also the alignment direction when multiple first flow channels 11 (second flow channels 21) are provided in parallel.

Figure 13:
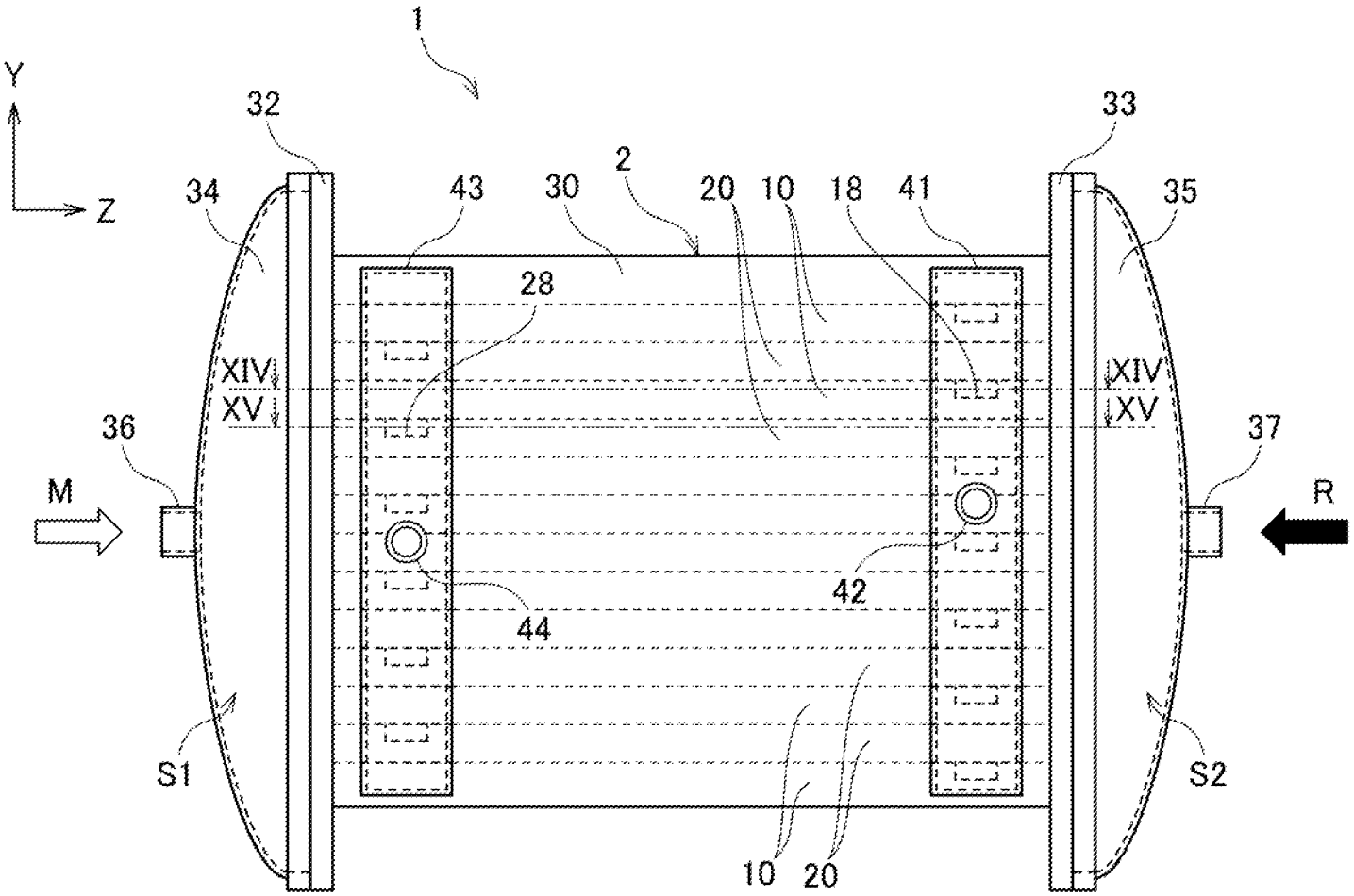
FIG. 13 is a side view illustrating a reactor including the heat exchange structure according to the present embodiment.
Figure 14:
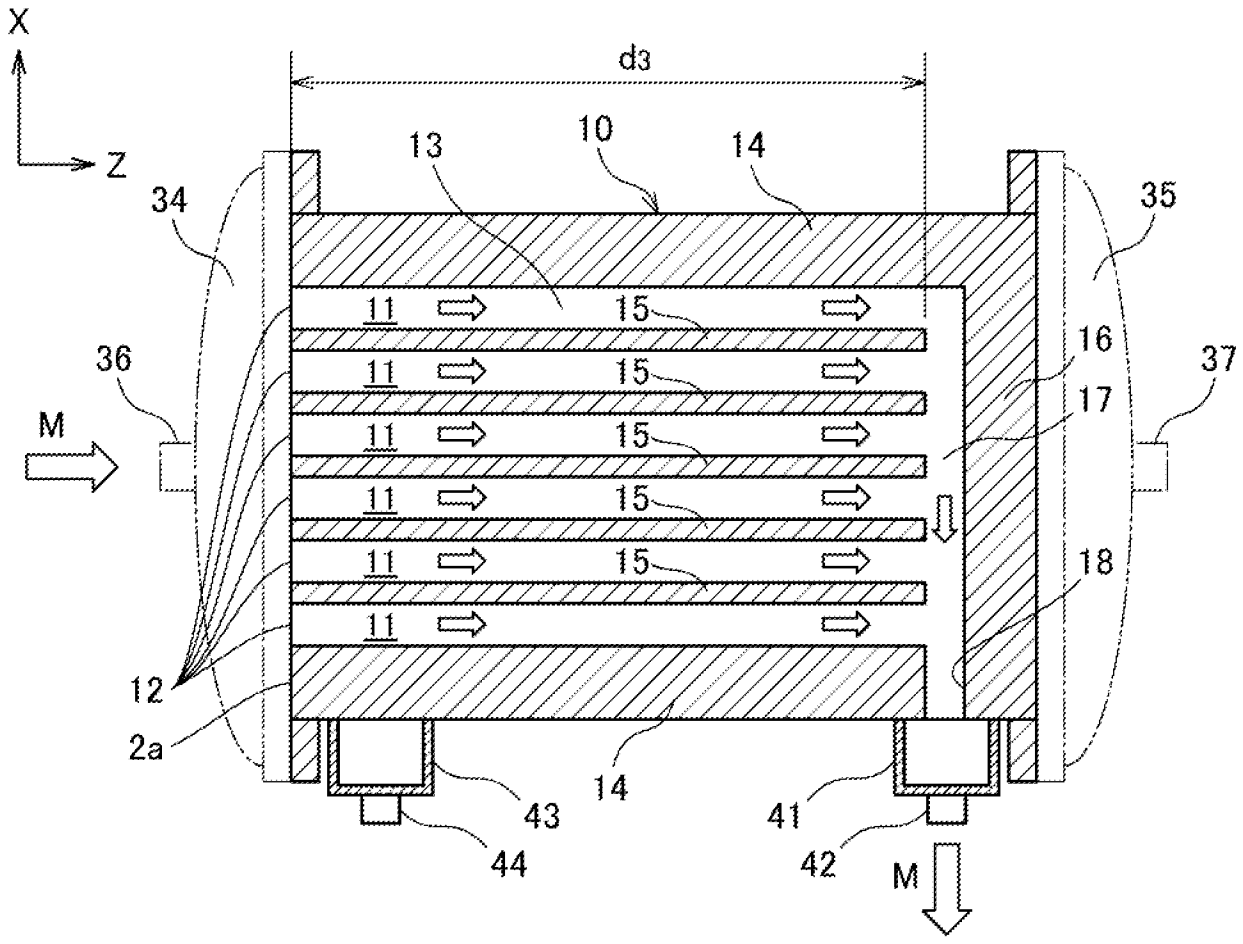
FIG. 14 is a cross-sectional view along the line XIV-XIV in FIG. 13.
Figure 15:
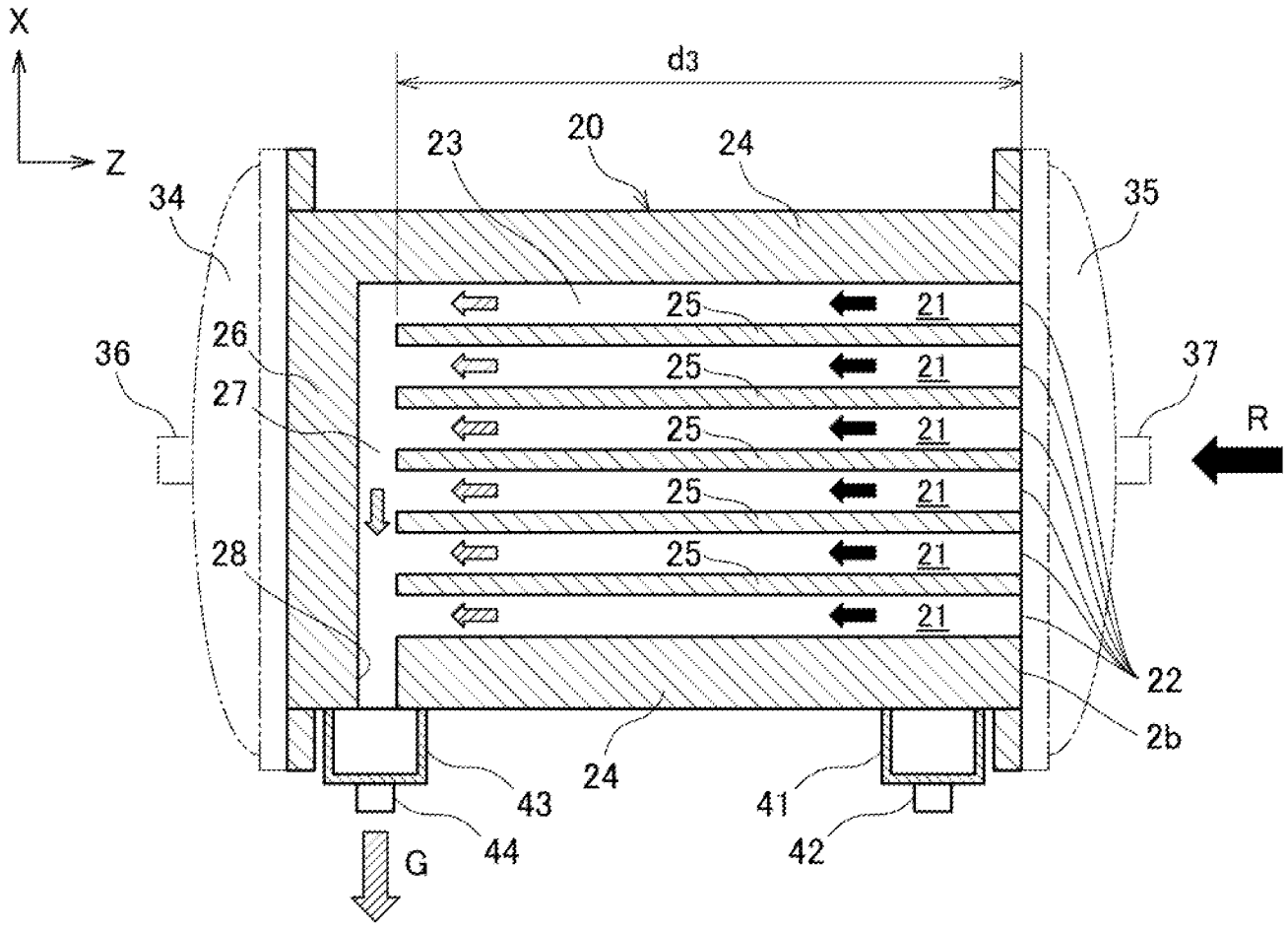
FIG. 15 is a cross-sectional view along the XV-XV line in FIG. 13.
Figure 16:
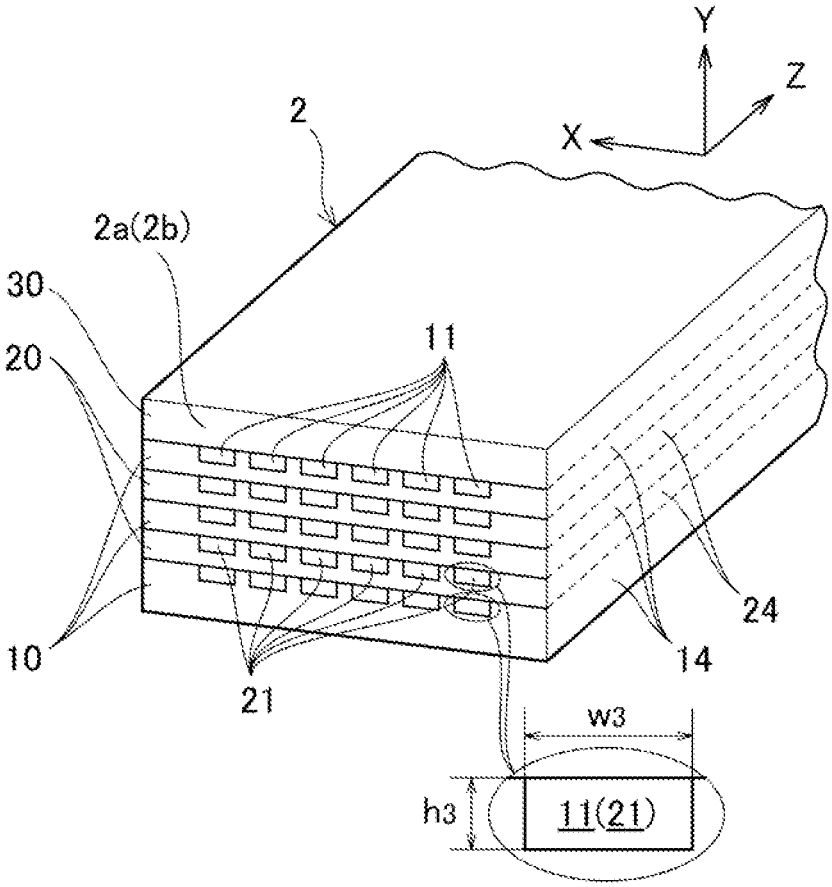
FIG. 16 is a three-dimensional view with a cross section illustrating a part of the heat exchange section according to the present embodiment.

FIG. 13 is a side view illustrating the reactor (catalytic reactor) 1 including the heat exchange structure 50 according to the present embodiment. FIG. 14 is a cross-sectional view taken along the line XIV-XIV in FIG. 13. FIG. 15 is a cross-sectional view taken along the line XV-XV in FIG. 13. FIG. 16 is a three-dimensional view with a cross section illustrating a part of the heat exchange section 2 as the heat exchange structure 50.

The reactor 1 heats or cools the reaction fluid R containing a reactive raw material to progress (promote) the reaction of the reaction fluid R. For the heating or cooling, the reactor 1 includes the heat exchange section 2 as the heat exchange structure 50 (see FIGS. 1A and 1B) that exchanges (transfers) heat between the heat medium M and the reaction fluid R. The heat exchange section 2 includes the first heat transfer bodies 10, the second heat transfer bodies 20, and a lid plate 30. The first heat transfer body 10, the second heat transfer body 20 and the lid plate 30 are flat plate members formed of heat-resistant and thermally conductive materials. They have sufficient thickness to withstand a high internal pressure generated while the reaction fluid R flows.

The first heat transfer body 10 includes channels (hereafter referred to as first channels) 11 through which the heat medium M flows. The second heat transfer body 20 includes channels (hereafter referred to as second channels) 21 through which the reaction fluid R flows. The first heat transfer bodies 10 and the second heat transfer bodies 20 are stacked alternately in the Y direction (i.e., the stacking direction). The lid plate 30 is set on the top of them.

With the stacking described above, the first flow channels 11 and the second flow channels 21 are adjacent to each other through a first partition 13 or a second partition 23 (see FIG. 16). In other words, the first flow channels 11 and the second flow channels 21 are stacked in a non-contact state in the stacking direction of the first heat transfer bodies 10 and the second heat transfer bodies 20. As described above, the first heat transfer body 10 and the second heat transfer body 20 are formed of a thermally conductive material. Therefore, the first flow channel 11 and the second flow channel 21 are thermally coupled to each other.

The heat exchange section 2 has a counter-flow type structure in which the reaction fluid R and the heat medium M flow in opposite directions. The fin structure 60 (see FIGS. 1A to 12) is detachably installed in the first flow channels 11, the second flow channels 21, or both. The fin structure 60 on which a catalyst is supported may be detachably installed in the second flow channel 21 through which the reaction fluid R flows.

The heat exchange section 2 is formed of at least one set of the first heat transfer body 10 and the second heat transfer body 20. The number of each heat transfer body may also be increased to improve the heat exchange performance. The number of channels formed in each heat transfer body is set depending on the design conditions of the heat exchange section 2, heat transfer efficiency, etc. In addition, a housing or insulation material may cover the heat exchange section 2 to reduce heat loss due to heat dissipation from the heat exchange section 2.

Both ends of the heat exchange section 2, which is a laminated body, are held by fixing members 32, 33.

A heat medium introduction section 34 is attached to the fixing member 32. The heat medium introduction section 34 is a concavely curved lid and forms a space S1 between the section 34 and the heat exchange section 2. First inlet ports 12 of the first flow channels 11 are opened toward the space S1 (see FIG. 14). In other words, the first inlet ports 12 are opened on the side surface (end face) 2*a* of the heat exchange section 2 facing the heat medium introduction section 34. The heat medium introduction section 34 has a first introduction tube 36 to introduce the heat medium M. The heat medium M flows into each first flow channel 11 through the first introduction tube 36.

The heat medium introduction section 34 is detachably or openably set on the fixing member 32. By this attachment and detachment, for example, the operator can insert and remove the fin structures 60 from the first flow channels 11.

The heat medium discharge section 41 is a box-shaped member having one opened face. The heat medium discharge section 41 is attached to the heat exchange section 2 so that the opened face faces the first discharge, ports 18 of the first heat transfer bodies 10. The heat medium discharge section 41 includes a first discharge pipe 42. The first discharge pipe 42 discharges the heat medium M that has passed through the heat exchange section 2.

A reaction fluid introduction section 35 is attached to the fixing member 33. As similar to the heat medium introduction section 34, the reaction fluid introduction section 35 is a concavely curved lid and forms a space S2 between the section 35 and the heat exchange section 2. Second inlet ports 22 of the second flow channels 21 are opened toward the space S2 (see FIG. 15). In other words, the second inlet ports 22 are opened on the side surface (end face) 2*b* of the heat exchange section 2 facing the reaction fluid introduction section 35. The reaction fluid introduction section 35 has a second introduction tube 37 to introduce the reaction fluid R. The reaction fluid R flows into each second flow channel 21 through the second introduction tube 37.

The reaction fluid introduction section 35 is detachably or openably set on the fixing member 33. By this attachment and detachment, for example, the operator can insert and remove the fin structures 60 from the second flow channels 21.

As similar to the heat medium discharge section 41, the product discharge section 43 is a box-shaped member having one opened face. The product discharge section 43 is attached to the heat exchange section 2 so that the opened face faces the second discharge port 28 of the second heat transfer body 20. The product discharge section 43 includes a second discharge pipe 44. The second discharge pipe 44 discharges the reaction gas G containing products derived from the reaction fluid R.

As shown in FIG. 14, the first heat transfer body 10 includes multiple first flow channels 11. The first flow channels 11 extend in the Z direction and are arranged in the X direction (the width direction). The first flow channels 11 supply the heat of the heat medium M to the first heat transfer body 10.

The first flow channels 11 are grooves formed on one surface (e.g., the upper surface in the present embodiment) of the first heat transfer body 10. Each groove has a rectangular cross section having a width w3 and a height h3 (see FIG. 16) and extends in one direction with a length of a depth d3 (see FIG. 14). The width w3 has a value greater than or equal to the width w1 of the fin structure 60. Similarly, the height h3 also has a value greater than or equal to the height h1 of the fin structure 60. The depth d3 is greater than the depth d1 of the fin structure 60.

The first flow channels 11 linearly extend from the first inlet ports 12 located on the side of the fixing member 32 toward the fixing member 33. As shown in FIG. 14, the multiple first flow channels 11 are arranged in parallel. The first flow channels 11 may be different in the width, height and length.

The first heat transfer body 10 includes a first partition 13, two first sidewalls 14, multiple first intermediate walls 15, and a first end wall 16. The first sidewalls 14, the first intermediate walls 15 and the first end wall 16 are provided on one side of the first partition 13. That is, they are provided on the same surface as the surface on which the first sidewall 14, etc. is provided for the first partition 13. The first partition 13 is a rectangular wall and defines the overall shape of the first heat transfer body 10. The first sidewall 14 are wall parts provided on both sides of the extending direction of the first flow channels 11. The first intermediate walls 15 are located between the two first sidewalls 14 and are wall parts provided in parallel with each first sidewall 14.

The first end wall 16 is provided on the opposite side of the first inlet ports 12 across the first flow channels 11. The first end wall 16 is a wall extending in the alignment direction of the first flow channels 11. The first end wall 16 blocks the inflow of the heat medium M toward the space S2.

The first heat transfer body 10 includes a first connection flow channel 17 extending along the first end wall 16. The first connection flow channel 17 is connected with all the first flow channels 11 and the first discharge port 18.

As shown in FIG. 15, the second heat transfer body 20 includes multiple second flow channels 21 including reaction regions. The middle section of the second flow channel 21 is the main reaction region. The second flow channels 21 extend in the Z direction and are arranged in the X direction (the width direction). The second flow channel 21 receives the heat of the heat medium M flowing through the first flow channel 11 in the first heat transfer body 10 to react the reaction fluid R to produce the reaction gas G containing the products derived from the reaction fluid R.

The second flow channels 21 are grooves formed on one surface (the upper surface in the present embodiment) of the second heat transfer body 20. Each groove has a rectangular cross section having a width w3 and a height h3 (see FIG. 16) and extends in one direction with a length of a depth d3 (see FIG. 15). The second flow channels 21 linearly extend from the second inlet ports 22 located on the side of the fixing member 33 toward the fixing member 32. As shown in FIG. 15, the multiple second flow channels 21 are arranged in parallel.

The second heat transfer body 20 includes a second partition 23, two second sidewalls 24, multiple second intermediate walls 25, and a second end wall 26. The second sidewalls 24, the second intermediate walls 25 and the second end wall 26 are provided on one side of the second partition 23. The second partition 23 is a rectangular wall and defines the overall shape of the second heat transfer body 20. The second sidewalls 24 are wall parts provided on both sides of the extending direction of the second flow channels 21. The second intermediate walls 25 are located between the two second sidewalls 24 and are wall parts provided in parallel with each second sidewall 24.

The second end wall 26 is provided on the opposite side of the second inlet ports 22 across the second flow channels 21. The second end wall 26 is a wall extending in the alignment direction of the second flow channels 21. The second end wall 26 blocks the inflow of the reaction gas G toward the space S1.

The second heat transfer body 20 includes a second connection flow channel 27 extending along the second end wall 26. The second connection flow channel 27 is connected with all the second flow channels 21 and the second discharge port 28. As similar to the first flow channel 11, the second connection flow channel 27 is a fluid channel, and there is no substantial difference between the two.

The heat exchange section 2 can be used as any of a liquid-liquid heat exchanger, a gas-gas heat exchanger and a gas-liquid heat exchanger. The reaction fluid R may be any of a gas and a liquid. The heat medium M may be any of a gas and a liquid. In addition, the reactor 1 of the present embodiment enables chemical synthesis through various thermal reactions such as endothermic and exothermic reactions. Examples of such syntheses by thermal reactions include endothermic reactions such as the steam reforming reaction of methane represented by formula (3), the dry reforming reaction of methane represented by formula (4), the shift reaction represented by formula (5), the methanation reaction represented by formula (6), and the Fischer-Tropsch synthesis reaction represented by formula (7). Note that the reaction fluid R in these reactions is a gas.

$$Ch_4+H_2O \rightarrow 3H_2+CO \quad (3)$$

$$CH_4+CO_2 \rightarrow 2H_2+2CO \quad (4)$$

$$CO+H_2O \rightarrow CO_2+H_2 \quad (5)$$

$$CO+3H_2 \rightarrow CH_4+H_2O \quad (6)$$

$$(2n+1)H_2+nCO \rightarrow C_nH_{2n+2}+nH_2O \quad (7)$$

It is desirable that the heat medium M is a substance that does not corrode the components of the reactor 1. When a heated gas is used as the heat medium M, gaseous materials such as a combustion gas and a heated air can be used. The heat medium M may be a liquid substance such as water or oil, for example.

It should be noted that the present disclosure is not limited to the embodiments described above, but is indicated by the claims, and further includes all modifications within and meaning equivalent to the scope of the claims.

What is claimed is:

1. A heat exchange structure comprising:

a partition;

two flow channels stacked each defined by walls surrounding a space through which fluid flows, the walls of each of the two flow channels including the partition as a part thereof, in a stacking direction through the partition and thermally coupled to each other through the partition, each of the two flow channels having an opening on any one of opposite sides in an extending direction thereof for fluid to flow into or out of; and a fin structure detachably installed from one of the openings in at least one flow channel of the two flow channels along the extending direction, wherein the fin structure includes fins arranged with intervals in a longitudinal direction of the at least one flow channel in which the fin structure is installed, the fins configured to form openings alternately arranged along the at least one flow channel on one side and the other side of the at least one flow channel in the stacking direction, and in the stacking direction, each opening has a height defined by a difference between a height of the at least one flow channel and a smallest height of a corresponding one of the fins.

2. The heat exchange structure according to claim 1, wherein the fins are perpendicular to the longitudinal direction of the at least one flow channel in which the fin structure is installed.

3. The heat exchange structure according to claim 1, wherein the fins are inclined with respect to the longitudinal direction of the at least one flow channel in which the fin structure is installed.

4. The heat exchange structure according to claim 1, wherein some of the fins are arranged at a different pitch from the other of the fins.

5. The heat exchange structure according to claim 1, wherein the fin structure includes a pair of strips configured to support the fins, provided on both sides of the arrangement of the fins in a direction intersecting the stacking direction.

6. The heat exchange structure according to claim 2, wherein the fin structure includes a pair of strips configured to support the fins, provided on both sides of the arrangement of the fins in a direction intersecting the stacking direction.

7. The heat exchange structure according to claim 3, wherein the fin structure includes a pair of strips configured to support the fins, provided on both sides of the arrangement of the fins in a direction intersecting the stacking direction.

8. The heat exchange structure according to claim 4, wherein the fin structure includes a pair of strips configured to support the fins, provided on both sides of the arrangement of the fins in a direction intersecting the stacking direction.

9. The heat exchange structure according to claim 1, wherein the fin structure includes:

a pair of strips provided on both sides of the arrangement of the fins in a direction intersecting the stacking direction; and support portions configured to link the pair of strips, provided between the pair of strips, and connected to a corresponding one of the fins.

10. The heat exchange structure according to claim 2, wherein the fin structure includes:

a pair of strips provided on both sides of the arrangement of the fins in a direction intersecting the stacking direction; and support portions configured to link the pair of strips, provided between the pair of strips, and connected to a corresponding one of the fins.

11. The heat exchange structure according to claim 3, wherein the fin structure includes:

a pair of strips provided on both sides of the arrangement of the fins in a direction intersecting the stacking direction; and support portions configured to link the pair of strips, provided between the pair of strips, and connected to a corresponding one of the fins.

12. The heat exchange structure according to claim 4, wherein the fin structure includes:

a pair of strips provided on both sides of the arrangement of the fins in a direction intersecting the stacking direction; and support portions configured to link the pair of strips, provided between the pair of strips, and connected to a corresponding one of the fins.

13. The heat exchange structure according to claim 9, wherein the fin structure is integrally formed of a single plate member.

14. The heat exchange structure according to claim 10, wherein the fin structure is integrally formed of a single plate member.

15. The heat exchange structure according to claim 11, wherein the fin structure is integrally formed of a single plate member.

16. The heat exchange structure according to claim 12, wherein the fin structure is integrally formed of a single plate member.

17. The heat exchange structure according to claim 5, wherein the fin structure includes connection portions supported by the pair of strips, configured to connect the fins so that the fins meander in a direction intersecting the stacking direction, and the fins and the connection portions are integrally formed of a single plate member.

18. The heat exchange structure according to claim 6, wherein the fin structure includes connection portions supported by the pair of strips, configured to connect the fins so that the fins meander in a direction intersecting the stacking direction, and the fins and the connection portions are integrally formed of a single plate member.

19. The heat exchange structure according to claim 7, wherein the fin structure includes connection portions supported by the pair of strips, configured to connect the fins so that the fins meander in a direction intersecting the stacking direction, and the fins and the connection portions are integrally formed of a single plate member.

20. The heat exchange structure according to claim 8, wherein the fin structure includes connection portions supported by the pair of strips, configured to connect the fins so that the fins meander in a direction intersecting the stacking direction, and the fins and the connection portions are integrally formed of a single plate member.

21. The heat exchange structure according to claim 1, wherein a catalyst is supported on the fin structure.

22. The heat exchange structure according to claim 1, wherein the fin structure has no structure interfering with heat transfer between the partition and a section of a meandering fluid path formed by the fin structure, the section located on a side facing the partition in a meandering direction of the fluid path.

* * * * *